US009120602B2

(12) United States Patent
Lagace

(10) Patent No.: US 9,120,602 B2
(45) Date of Patent: Sep. 1, 2015

(54) STAND-UP CAULK DISPENSER

(71) Applicant: Sonoco Development Incorporated, Hartsville, SC (US)

(72) Inventor: Chad Lagace, Cohoes, NY (US)

(73) Assignee: Sonoco Development Incorporation, Charlotte, NC (US)

( * ) Notice: Subject to any disclaimer, the term of this patent is extended or adjusted under 35 U.S.C. 154(b) by 27 days.

(21) Appl. No.: 13/649,705

(22) Filed: Oct. 11, 2012

(65) Prior Publication Data

US 2014/0103067 A1 Apr. 17, 2014

(51) Int. Cl.
*B65D 35/56* (2006.01)
*B65D 35/44* (2006.01)
*B65D 51/24* (2006.01)

(52) U.S. Cl.
CPC ..... *B65D 35/44* (2013.01); *B65D 51/249* (2013.01); *B65D 35/56* (2013.01)

(58) Field of Classification Search
CPC ..... B65D 2251/023; B65D 2255/20; B65D 2543/0012; B65D 41/0485; B65D 45/16; B65D 47/122; B65D 35/44; B65D 35/46; B65D 35/56; B65D 35/565; B65D 51/249
USPC ..... 222/562, 554, 563, 92–107, 552, 546, 222/212–215; 215/43, 44; 248/128, 132, 248/134, 311.3
See application file for complete search history.

(56) References Cited

U.S. PATENT DOCUMENTS

| | | | | | |
|---|---|---|---|---|---|
| 3,353,714 | A | * | 11/1967 | Trecek | 222/107 |
| 4,470,521 | A | * | 9/1984 | Scammell | 222/107 |
| 4,666,063 | A | * | 5/1987 | Holoubek et al. | 222/107 |
| 5,104,013 | A | | 4/1992 | Hawley | |
| 5,118,012 | A | | 6/1992 | Miller et al. | |
| 5,160,057 | A | * | 11/1992 | Fitjer | 215/44 |
| 5,239,725 | A | | 8/1993 | White | |
| 5,301,843 | A | | 4/1994 | Groene et al. | |
| 5,346,380 | A | | 9/1994 | Ables | |
| 5,588,560 | A | | 12/1996 | Benedict et al. | |
| 5,908,644 | A | | 6/1999 | Poole | |
| 5,992,656 | A | * | 11/1999 | Dujardin et al. | 215/44 |
| 7,127,769 | B2 | | 10/2006 | Chang et al. | |
| 7,243,663 | B1 | * | 7/2007 | Einstein et al. | 132/314 |
| 7,281,875 | B1 | | 10/2007 | Todd | |
| 8,123,058 | B2 | * | 2/2012 | Brozell et al. | 215/216 |
| 8,434,652 | B2 | * | 5/2013 | Rushe et al. | 222/549 |

* cited by examiner

*Primary Examiner* — Frederick C Nicolas
*Assistant Examiner* — Bob Zadeh
(74) *Attorney, Agent, or Firm* — Nelson, Mullins, Riley & Scarborough, LLP

(57) ABSTRACT

The present application relates to a caulk dispenser. The dispenser includes a tube member having an internal chamber for holding caulk, where the chamber defines a volume. The tube member further comprises a first end with an outlet port and a second closed end. The dispenser further includes a cap member with a first end and a second end, where the cap member first end forms a substantially flat surface.

20 Claims, 3 Drawing Sheets

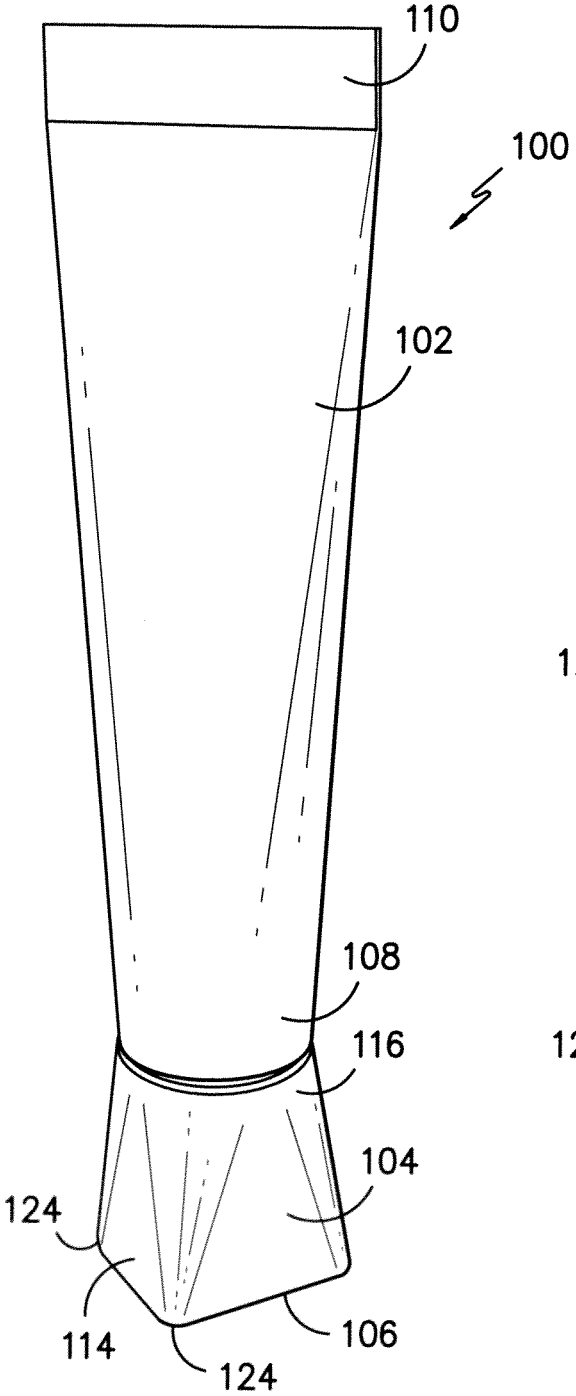
FIG. –1–
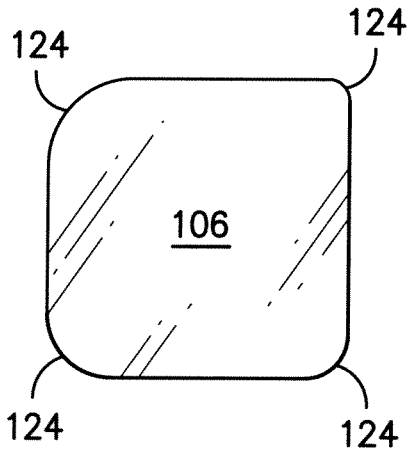
FIG. –2–

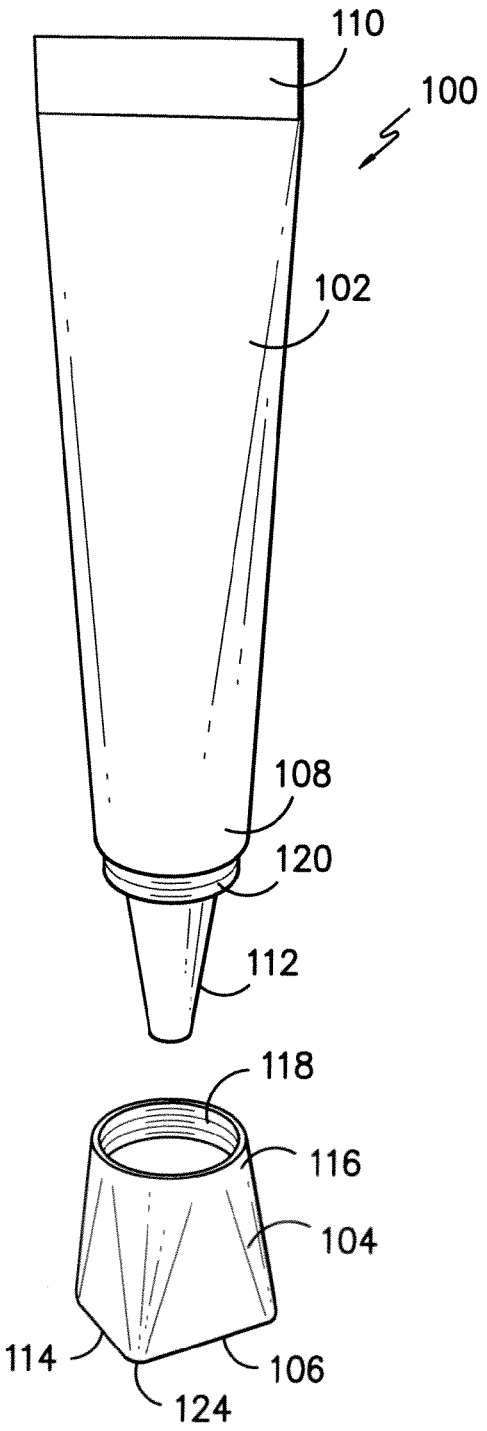
FIG. –3–
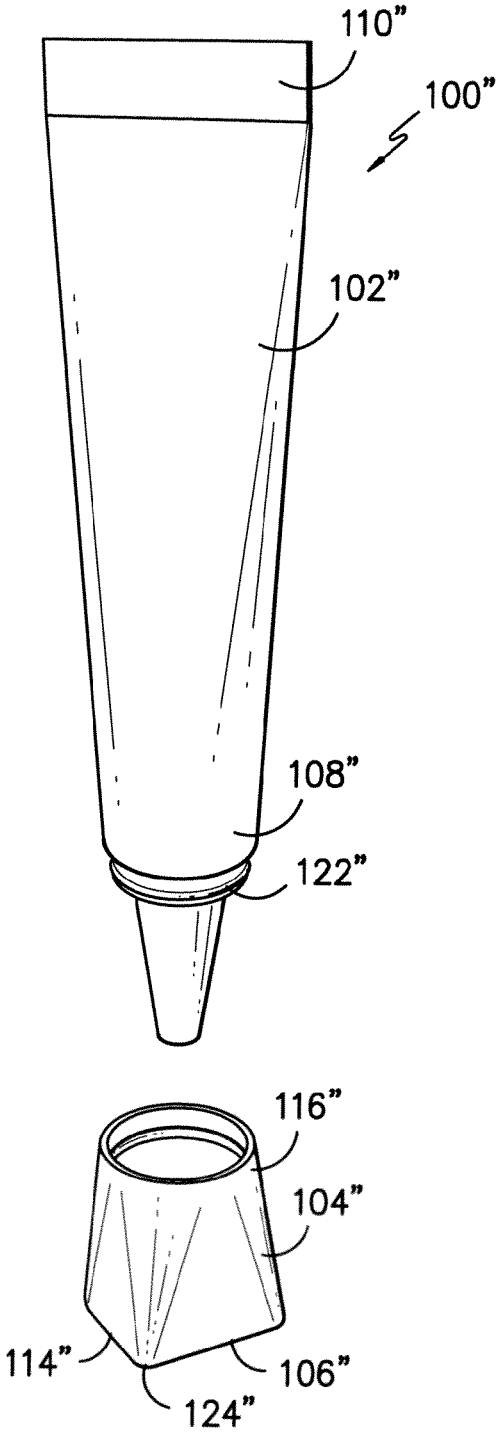
FIG. –4–

STAND-UP CAULK DISPENSER

FIELD OF THE INVENTION

The present invention relates generally to caulk dispensers and more particularly to caulk dispensers that may remain in upright orientations.

BACKGROUND OF THE INVENTION

Caulk dispensers are employed to apply a bead of viscous sealing material to a surface. Such dispensers have use in a wide variety of applications, including household and commercial use.

SUMMARY OF THE INVENTION

According to an aspect, the present invention provides a caulk dispenser comprising a tube member having an internal chamber for holding caulk, the chamber defining a volume, the tube member further comprising a first end defining an outlet port and a second closed end; and a cap member comprising a first end and a second end, wherein the cap member first end forms a substantially flat surface and having a plurality of rounded corners, wherein at least two of the corners comprise different radii of curvature, and wherein the cap member second end is selectively attached to the tube member first end.

According to another aspect, the present invention provides a caulk dispenser comprising a tube member having an internal chamber for holding caulk, the chamber defining a volume, the tube member further comprising a first end defining an outlet port and a second closed end and wherein the chamber volume decreases from the tube member second closed end to the tube member first end; and a cap member comprising a first end and a second end, wherein the cap member first end forms a substantially flat surface and having a plurality of rounded corners, wherein at least two of the corners comprise different radii of curvature, and wherein the cap member second end is selectively attached to the tube member first end.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 1 is a front perspective view of a caulk dispenser in accordance with an embodiment of the present invention;

FIG. 2 is a bottom view of a cap member of the caulk dispenser of FIG. 1;

FIG. 3 is an exploded view of the of the caulk dispenser of FIG. 1;

FIG. 4 is an exploded view of a caulk dispenser in accordance with an additional embodiment of the present invention.

Figure 5:
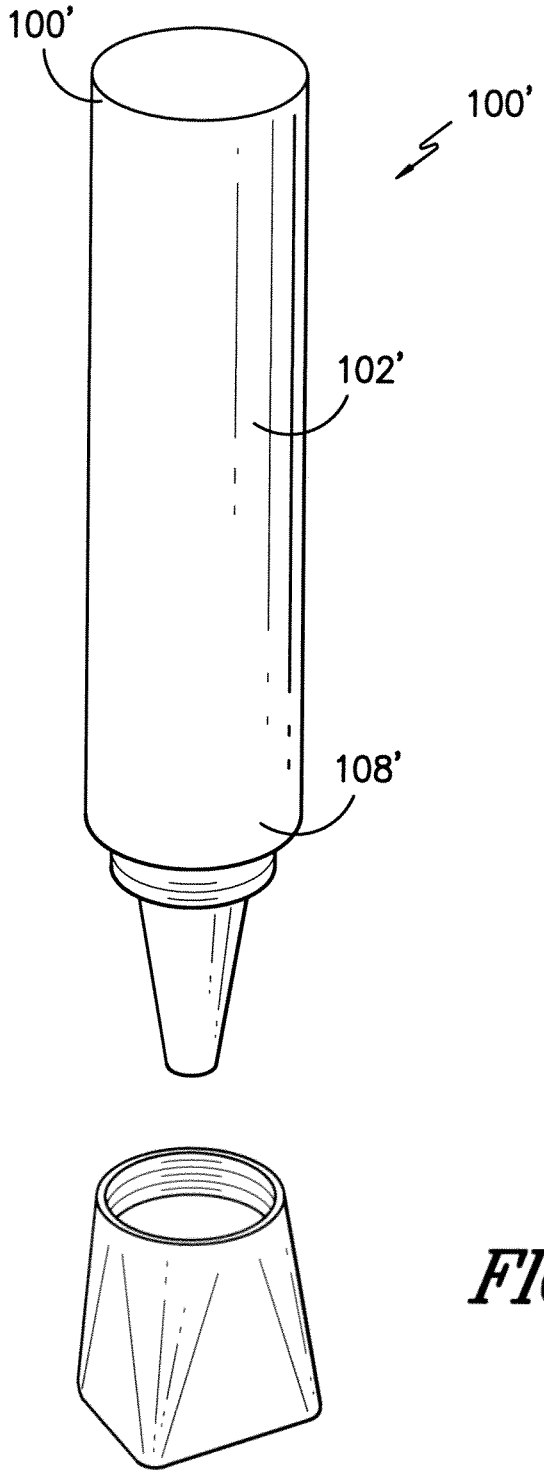
FIG. 5 is an exploded view of a caulk dispenser in accordance with a further embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to certain embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

A caulk dispenser 100 in accordance with an embodiment of the present invention is shown in FIGS. 1 through 3. As shown in FIG. 1, caulk dispenser 100 includes a tube member 102, for housing the caulk to be dispensed, that is connected to a cap member 104. As further explained below, cap member 104 includes a substantially flat surface 106 that allows for caulk dispenser 100 to stand in a balanced, vertical orientation. Such configuration further allows for caulk dispenser 100 to provide a consistent, prominent, and desirable display option.

Tube member includes an internal chamber (not shown) that defines a volume between a first end 108 and a sealed second end 110 of tube member 102. Tube member 102 may be shaped as required by the user to effectively house the caulk material and to also, in some embodiments, allow caulk dispenser 100 to maintain an upright orientation when desired. For example and as shown in FIG. 1, tube member 102 may be shaped such that the volume of the internal chamber decreases between second end 110 and first end 108. In additional embodiments of the present invention and as shown in FIG. 5, tube member 102' may be shaped such that the volume of the internal chamber remains substantially the same between second end 110' and first end 108'. The user's specifications may dictate the particular shape of the tube member utilized and a cylindrical tube member is shown in FIG. 5 merely as an example of one such particular shape.

Tube member 102 may be constructed of any material known in the art for housing caulking materials. For example in some embodiments, tube member 102 may be constructed of paper, plastic, or other materials. In some embodiments of the present invention, tube member 102 may be constructed of a flexible material, such as plastic, such that a user may apply force to tube member 102 to aid in dispensing caulk from caulk dispenser 100.

As shown in FIG. 3, tube member first end 108 includes an outlet port 112 that is in fluid communication with the internal chamber of tube member 102. Outlet port 112 is positioned on tube member first end 108 such that caulking material may exit caulk dispenser 100 when desired by the user. Outlet port 112 may be formed integrally with tube member 102 or may be separately attached by means known in the art, such as by a mating screw thread arrangement. Outlet port 112 may be shaped as required by the user. For example, outlet port 112 may include an outwardly extending conical shape such that a thin layer of caulk may exit outlet port 112. However, in additional embodiments, outlet port 112 may be shaped as a hole or any other shape as desired by the user.

As shown in FIGS. 1 and 2, cap member 104 includes a first end 114 with a substantially flat surface 106 and a second end 116 that is selectively connected to tube member first end 108. In order to establish the selective connection between cap member second end 116 and tube member first end 108, various methods may be utilized. For example and as shown in FIG. 3, cap member second end 116 may include a threaded portion 118 that is selectively mated with a threaded portion 120 of tube member first end 108. In additional embodiments, and as shown in FIG. 4, tube member second end 110" may include an outer lip 122" such that cap member second end 116" may "snap-fit" and connect to tube member 102". In further embodiments, other connection methods known in the art may be utilized. The user's specifications may dictate the particular embodiments employed.

As indicated above, cap member first end 114 includes a substantially flat surface 106 that may, in some embodiments, aid in maintaining caulk dispenser 100 in a vertical orientation. As shown in FIGS. 1 through 3, substantially flat surface 106 may include corners 124, for example four, as shown. Although the embodiment of the figures is shown with four corners, it should be noted that in additional embodiments, substantially flat surface may include three, five, six, seven, eight, or more corners. In embodiments of the present invention, at least two of the corners 124 of substantially flat surface 106 include radii of curvature that are different from one another. For example, the radii of curvature may range between about 0 inches to more than about one inch where, in some embodiments, one corner may include a radius of curvature greater than about 0.25 inches and another corner may include a radius of curvature less than about 0.25 inches. Further, in some embodiments where four corners are utilized, a first corner may include a radius of curvature between about 0 inches to about 0.125 inches, a second corner may include a radius of curvature between about 0.125 inches to about 0.25 inches, a third corner may include a radius of curvature between about 0.25 inches to about 0.5 inches, and a fourth corner may include a radius of curvature greater than about 0.5 inches.

The use of different corner sizes allows for a user to smooth the viscous material deposited from caulk dispenser in a particular corner, regardless of the size of the corner. In use, the cap may be employed for smoothing caulk that has been dispensed. The provision of different corner sizes allows for the matching of a corner of the cap member 104 to the corner or seam into which caulk has been dispensed.

Cap member 104 may be constructed of materials sufficient to allow caulk dispenser 100 to maintain the vertical orientation of caulk dispenser 100 as discussed above. For example, in some embodiments, cap member 100 may include plastic, metal, combinations of the two or other materials known in the art.

The construction of the caulk dispenser of the present invention, as indicated above, allows for the caulk dispenser to remain in a balanced, vertical orientation when not in use. Such advantages allow a retailer to display the dispenser in a more consistent, prominent, and desirable display options at retail stores or other locations over existing dispensers, which are typically either placed in boxes with dividers or are displayed in an unreliable, unbalanced position. In addition, the vertical orientation allows for the dispenser to remain in one place when it is in use by a user instead of possibly rolling away. It should be noted that although the dispensers of the present invention have been described in connection with the holding and dispensing of caulking materials, in other embodiments, the dispensers of the present invention could be utilized in connection with other materials as well. For example, the dispensers of the present may be used in connection with glue, paints, or other materials. The user's specifications may dictate the necessary material to be housed and dispensed by the dispensers of the present invention.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A caulk dispenser comprising:

a tube member having an internal chamber for holding caulk, the internal chamber defining a volume, the tube member further comprising a tube member first end defining an outlet port and a tube member second closed end; and a cap member comprising a cap member first end and a cap member second end, wherein the cap member first end forms a substantially flat surface with a plurality of rounded corners, wherein at least two of the rounded corners comprise different radii of curvature, wherein the cap member first end has an outermost perimeter length that is greater than the outermost perimeter length of the cap member second end, and wherein the cap member second end is selectively attached to the tube member first end.

2. The caulk dispenser of claim 1, wherein the tube member comprises a flexible plastic.

3. The caulk dispenser of claim 1, wherein the cap member comprises a hard plastic, metal or both.

4. The caulk dispenser of claim 1, wherein the cap member comprises at least four corners.

5. The caulk dispenser of claim 1, wherein the outlet port comprises a conical shape.

6. The caulk dispenser of claim 1, wherein the tube member first end includes a lip for selectively mating with the cap member second end.

7. The caulk dispenser of claim 1, wherein the tube member first end comprises a threaded portion and the cap member second end comprises a threaded portion that are selectively mated with each other.

8. A caulk dispenser comprising:

a tube member having an internal chamber for holding caulk, the chamber defining a volume, the tube member further comprising a tube member first end defining an outlet port and a tube member second closed end and wherein the internal chamber volume decreases from the tube member second closed end to the tube member first end; and a cap member comprising a cap member first end and a cap member second end, wherein the cap member first end forms a substantially flat surface with a plurality of rounded corners, wherein at least two of the rounded corners comprise different radii of curvature, wherein the cap member first end has an outermost perimeter length that is greater than the outermost perimeter length of the cap member second end, and wherein the cap member second end is selectively attached to the tube member first end.

9. The caulk dispenser of claim 8, wherein the tube member comprises a flexible plastic.

10. The caulk dispenser of claim 8, wherein the cap member comprises a hard plastic, metal or both.

11. The caulk dispenser of claim 8, wherein the cap member comprises at least four corners.

12. The caulk dispenser of claim 8, wherein the outlet port comprises a conical shape.

13. The caulk dispenser of claim 8, wherein the tube member first end includes a lip for selectively mating with the cap member second end.

14. The caulk dispenser of claim 8, wherein the tube member first end comprises a threaded portion and the cap member second end comprises a threaded portion that are selectively mated with each other.

15. A cap member for capping an outlet port on a container, the cap member comprising a cap member first end and a cap member second end, wherein the cap member second end is configured to selectively attach to a container to cap an outlet port on the container, wherein the cap member first end has an outermost perimeter length that is greater than the outermost perimeter length of the cap member second end; and a substantially flat surface with a plurality of rounded corners formed at the cap member first end and wherein at least two of the rounded corners comprise different radii of curvature.

16. The cap member of claim 15, wherein at least one of the rounded corners has a radius of curvature greater than about 0.25 inches and at least one of the rounded corners has a radius of curvature less than about 0.25 inches.

17. The cap member of claim 15, wherein the cap member comprises a hard plastic, metal or both.

18. The cap member of claim 15, wherein the cap member comprises four corners.

19. The cap member of claim 18, wherein a first corner comprises a radius of curvature between about 0 inches to about 0.125 inches, a second corner comprises a radius of curvature between about 0.125 inches to about 0.25 inches, a third corner comprises a radius of curvature between about 0.25 inches to about 0.5 inches, and a fourth corner comprises a radius of curvature greater than about 0.5 inches.

20. A material dispenser comprising:

a tube member having an internal chamber for holding a material, the internal chamber defining a volume, the tube member further comprising a tube member first end defining an outlet port and a tube member second closed end; and a cap member comprising a cap member first end and a cap member second end, wherein the cap member first end forms a substantially flat surface with a plurality of rounded corners, wherein at least two of the rounded corners comprise different radii of curvature, wherein the cap member first end has an outermost perimeter length that is greater than the outermost perimeter length of the cap member second end and wherein the cap member second end is selectively attached to the tube member first end.

* * * * *